US009359894B2

(12) United States Patent
Voitic et al.

(10) Patent No.: US 9,359,894 B2
(45) Date of Patent: Jun. 7, 2016

(54) CUTTING BIT AND BIT ASSEMBLY

(71) Applicant: SANDVIK INTELLECTUAL PROPERTY AB, Sandviken (SE)

(72) Inventors: Hannes Voitic, Weiβkirchen (AT); Joe Fader, Graz (AT)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 12 days.

(21) Appl. No.: 14/490,800

(22) Filed: Sep. 19, 2014

(65) Prior Publication Data

US 2015/0076894 A1 Mar. 19, 2015

(30) Foreign Application Priority Data

Sep. 19, 2013 (EP) ..... 13185211

(51) Int. Cl.
*E21C 35/18* (2006.01)
*E21C 35/197* (2006.01)

(52) U.S. Cl.
CPC ..... *E21C 35/18* (2013.01); *E21C 35/197* (2013.01); *E21C 2035/1806* (2013.01)

(58) Field of Classification Search
CPC ..... E21C 35/19; E21C 35/197
See application file for complete search history.

(56) References Cited

U.S. PATENT DOCUMENTS

| | | | | |
|---|---|---|---|---|
| 5,730,502 | A * | 3/1998 | Montgomery, Jr. | E21C 35/197 299/104 |
| 6,712,431 | B1 | 3/2004 | Bosch et al. | |
| 7,635,168 | B2 * | 12/2009 | Hall | A47C 3/00 299/104 |
| 2004/0026132 | A1 | 2/2004 | Hall et al. | |

FOREIGN PATENT DOCUMENTS

| | | | | |
|---|---|---|---|---|
| DE | 2846744 | A1 | 10/1978 | |
| DE | EP 1574309 | A1 * | 9/2005 | E21C 35/18 |
| EP | 2514918 | A1 | 10/2012 | |
| SE | EP 2514918 | A1 * | 10/2012 | E21C 35/19 |

* cited by examiner

*Primary Examiner* — John Kreck
(74) *Attorney, Agent, or Firm* — Corinne R. Gorski

(57) ABSTRACT

A cutting bit and bit assembly for mounting at a cutting machine. The bit includes an axially tapered bit body having a recess extending axially within the body. The recess has an innermost region and a mouth region that is generally convex and/or tapered radially outward to abut a corresponding concave or tapered surface of a projection to secure the cutting bit at a holder body. An annular step is positioned within the recess at the mouth region to prevent dust and contaminant fluid or particles from passing axially into the recess.

19 Claims, 4 Drawing Sheets

CUTTING BIT AND BIT ASSEMBLY

RELATED APPLICATION DATA

This application claims priority under 35 U.S.C. §119 to EP Patent Application No. 13185211.3, filed on Sep. 19, 2013, which the entirety thereof is incorporated herein by reference.

TECHNICAL FIELD

A cutting bit for mounting at a cutting machine and in particular, although not exclusively, to a bit having a step profile at a mouth region of a recess for cooperative mounting at a projection to secure the cutting bit to a holder body.

BACKGROUND

Rock cutting and excavation machines have been developed for various specific applications including mining, trenching, tunnelling, foundation drilling, road milling, etc. Typically, a drive body in the form of a rotatable drum or drill head comprises a plurality of replaceable cutting bits that provide the points of contact for the material or mineral face.

For example, a mobile mining machine includes a rotatable cutting head with the cutting bits provided on rotating drums. As the bits contact the surface of the seam they occasionally break and inevitably wear resulting in decreased cutting inefficiency and a need for replacement. It is therefore desirable to mount the cutting bits at the cutting head (or drive body) via releasable mounting assemblies that enable the bits to be replaced conveniently and quickly during servicing and repair.

Cutting bit (alternatively termed 'cutting pick' or 'tool pick') mountings are described in U.S. Pat. Nos. 3,342,531; 3,627,381; 3,932,952; 4,343,516; 5,261,499; WO 96/31682; US 2008/0258536; US 2008/0309148; WO 2010/027315; US 2011/0278908 and EP 2514918.

Cutting bits have been developed that may be considered to fall in at least two general categories. A first general type comprises a nose portion attached at one end of an elongate shaft whilst a second type comprises a bit head having an inner cavity that fits onto an end of an 'adaptor' that comprises a projection head and an elongate shaft, with the head received within the inner cavity of the bit and the shank secured at a through bore extending within a mount body.

A requirement of projection mounted cutting bits of the type described in EP 2514918 is that the bit is capable of unhindered rotation about the projection during cutting. Additionally, the recess region of the bit and parts of the projection must mate cooperatively so as to effectively transfer the significant compressive forces encountered during use. Due to the harsh working environment of the cutting bits, it is common for dust particles and the like to be entrained into the region of the bit recess causing hindered rotation of the bit head and accordingly premature wear that in turn significantly lowers the operational lifetime of the bit and can damage the bit holder. There is therefore a need for a cutting bit and mounting assembly that addresses these problems.

SUMMARY

The present disclosure discloses a cutting bit and a bit assembly for mounting the bit at a cutting machine inhibit and preferably prevent particles, dust and contaminant fluids from passing into a region between the cutting bit and the mounting projection on which the bit is seated. The bit and mounting assembly is optimised to allow transfer of the loading forces through the bit and mounting whilst minimising fatigue and stress concentrations.

This is achieved by providing a cutting bit having a recess to receive a mounting projection in which the recess has a mouth region with a stepped internal surface profile. Such a configuration significantly reduces or completely prevents contaminant particles from passing axially beyond the step towards the innermost region of the recess. In particular, the radially inward facing surface of the recess (and radially outward surface of the projection), axially forward of the recess mouth, are profiled both to inhibit axial advancement of dust particles and to optimise transfer of loading forces from the bit to the mounting projection. This may be achieved as a region of the recess axially inward/forward of the mouth having a convex and/or radially outward tapered profile that has an initial step in the surface profile at the very opening of the recess mouth.

The present configuration is both self-centring during cutting and is also effective to expel or prevent particulates from entering the recess due to the rotational action of the bit about a longitudinal axis extending through the bit and projection.

According to a first aspect of the present disclosure there is provided a cutting bit for mounting at a cutting machine including an axially tapered bit body having a forward end providing or mounting a cutting tip and a rearward end for mounting at a bit holder; a recess extending axially within the body from the rearward end, the recess having an innermost region and a mouth region located substantially at the rearward end, the recess defined axially by a radially inward facing annular surface; a groove projecting radially outward into the body from the recess at an axial position between the innermost region and the mouth region; the radially inward facing surface having a section that is generally convex and/or tapered radially outward at an axial position between the groove and rearward end to abut a corresponding concave or tapered surface of a projection to secure the cutting bit at a holder body. An annular step is positioned within the recess at the mouth region axially between the section and the rearward end, the step defined by i) a convex mouth surface that is an axially rearward part of the section and that terminates axially at the step and ii) an annular entrance surface extending axially forward from the rearward end and aligned transverse or perpendicular to the mouth surface.

A radius of at least a part of the surface at section can be greater than or equal to a fifth or a quarter of a distance from the rearward end of the body to an axially forwardmost region of the groove. Such a configuration is effective to optimise the transmission of load between the bit and the projection.

The entrance surface can be aligned substantially parallel with the longitudinal axis of the bit. The transverse alignment of the entrance surface relative to the axially rearwardmost part of the convex and/or tapered surface of the recess mouth provides an angled junction that inhibits axial progression of contaminants. The step is efficiently formed from this axially parallel entrance surface and the convex and/or tapered surface to maximise the radial distance by which the recess is flared outwardly to achieve optimum load transfer.

The innermost region of the recess may be defined by a substantially planar surface bordered at a perimeter by an annular concave surface region. Such a configuration is advantageous to facilitate manufacture/machining and to optimise load transfer.

The radially inward facing surface axially between the groove and the rearward end can be exclusively convex and/or tapered radially outward. Optionally, the inward facing surface can include a short cylindrical section positioned axially between the groove and the generally convex and/or tapered section. The radially inward facing surface axially between the groove and the rearward end can be devoid of a section that is concave. The convex and/or radially outward tapered section can extend directly axially forward of the annular step.

A width or diameter of the substantially planar surface (excluding any surrounding annular convex region) can be 50% to 100% of an axial depth of the recess between the rearward end of the body and an axially innermost region/end of the groove.

The surface at section can include a first convex region extending axially rearward of the groove and the convex mouth surface extending axially forward from the entrance surface. A surface profile of the recess at a region axially between the first convex region and the mouth surface can be tapered radially outward from the first convex region to the mouth surface. A surface profile of the recess at a region axially between the first convex region and the mouth surface can be convex to provide a singularly convex surface extending axially between the groove and the entrance surface.

An axial length of the groove can be in the range 20 to 45% of an axial depth of the recess between the innermost region and the rearward end of the body. An axial length of the groove can be in the range 30 to 60% and preferably 40 to 55% of an axial distance of the recess between the rearward end of the body and an axially forwardmost region of the groove. This relatively large surface area contact is advantageous to 'balance' the cutting bit assembly so as to stabilise the bit at the projection and allow non-oscillating rotation of the bit. Accordingly, the contact between the retainer and the projection is optimised with respect to an axial length of the recess and projection.

According to a second aspect of the present disclosure there is provided a cutting bit assembly for mounting at a cutting machine including a holder body mounted or mountable at a region of a cutting machine; a projection extending from the body and configured to be received within the recess of the cutting bit.

The projection can include a head and a skirt wherein the head is positionable at or towards the innermost region of the recess and a radially outermost surface region of the skirt is configured to be accommodated within the annular step at or in near-touching contact with the entrance surface. The projection may have a concave and/or radially outward tapered surface at the region of the skirt to mate cooperatively with the surface at section of the recess. The skirt and the recess can be configured such that the skirt fully occupies the recess at the region of the mouth and in particular the step formed by the entrance surface and the convex and/or tapered surface of the recess. In particular, the step region is formed by the junction between the concave and/or tapered region and the entrance surface with these respective surfaces being aligned transverse or perpendicular to one another at their annular region of contact.

The assembly further includes a locking collar positionable radially around a region of the projection and configured to be accommodated within the groove to provide an axial lock of the bit at the projection. The locking collar may be formed from a ferrule, split-ring or annular component formed as a single or unitary body. The collar may also be formed as a bearing or multiple-component bearing assembly accommodated within the groove region radially between the bit and the projection.

The holder body may include a through bore and the projection having a rearwardly extending shaft, the shaft mountable within the bore to secure the projection at the holder body. The shaft can be locked at the holder body via an externally mounted nut or via a locking component mounted within the holder body.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF DRAWINGS

A specific implementation of the present disclosure will now be described, by way of example only, and with reference to the accompanying drawings in which.

DETAILED DESCRIPTION

Figure 1:
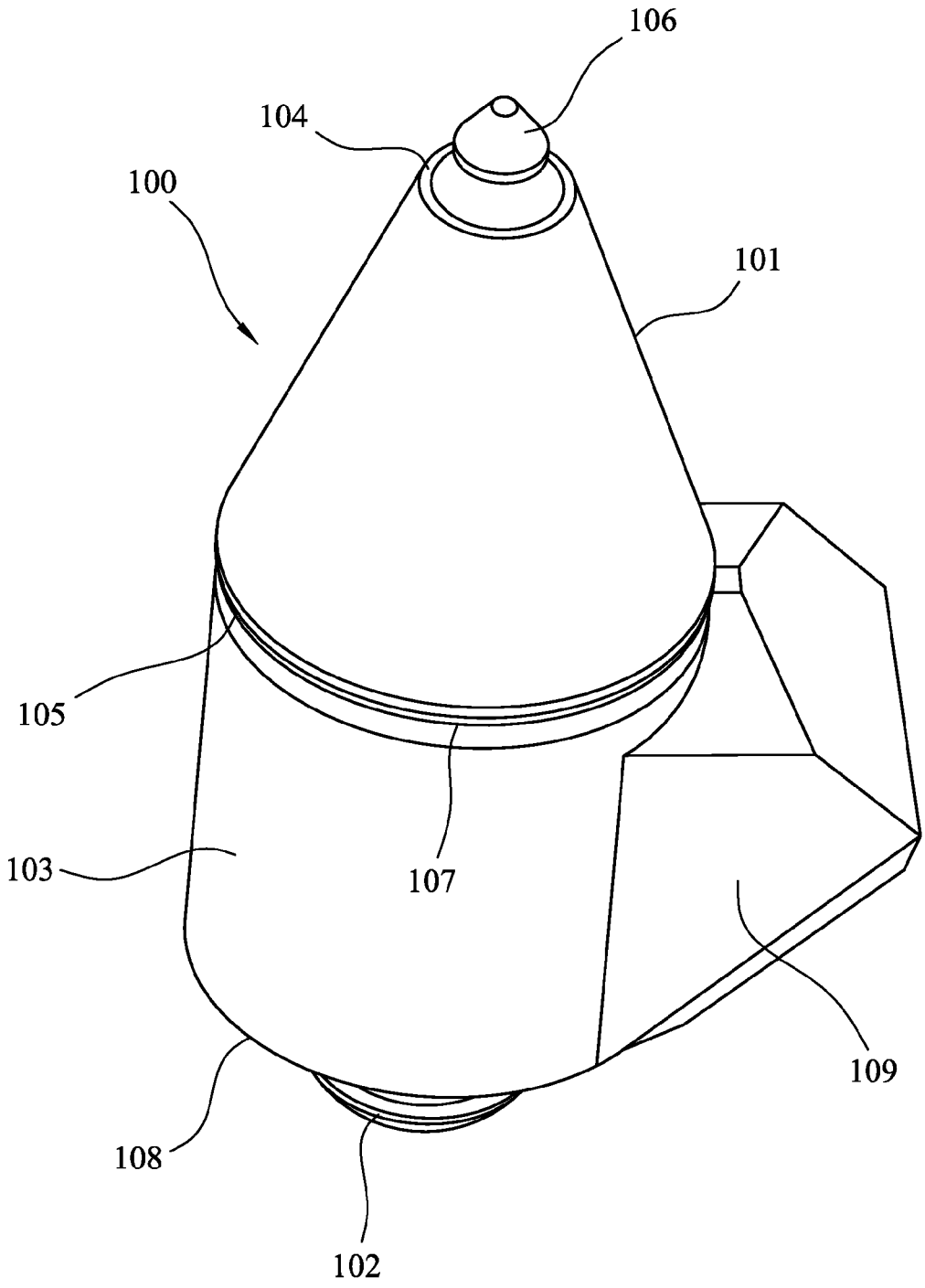
FIG. 1 is a perspective view of a cutting bit assembly in which a cutting bit is rotatably mounted at a mount body via an intermediate shank-like adaptor according to a specific implementation of the present invention.

Referring to FIG. 1, a cutting bit assembly 100 is configured for mounting at an external surface of a rotatable cutting head (or drum) of a cutting machine (not shown). The assembly 100 includes a cutting bit 101 releasably and rotatably mounted at a cutting bit holder 103 via an elongate adaptor 102 that is, in turn, releasably mounted at bit holder body 103. Bit 101 has a generally conical shape profile having a forwardmost end 104 that mounts a cutting tip 106 and rearwardmost end 105 mounted at a forwardmost end 107 of holder body 103. Holder body 103 is mounted at a cutting head (or drum) of a cutting machine (not shown) via a mounting flange 109 projective laterally from a side of holder body 103 from a rearwardmost region 108.

Figure 2:
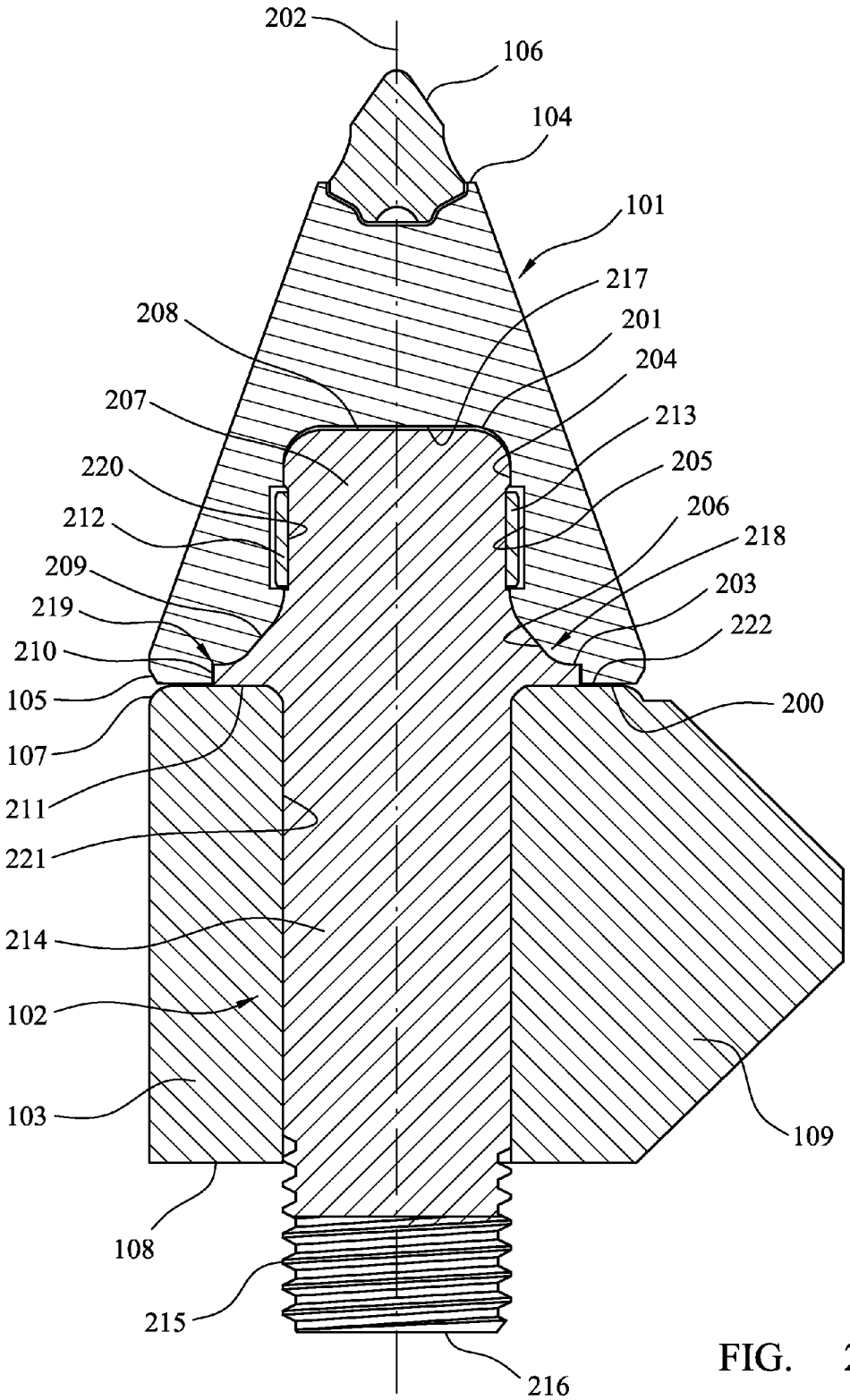
FIG. 2 is a cross sectional side view through the cutting bit assembly of FIG. 1.

Referring to FIG. 2, bit 101 includes an internal recess indicated generally by reference 201 that extends axially into bit 101 from rearward end 105 and in particular a rearward annular end surface 200. Recess 201 has an innermost end surface 217 aligned substantially perpendicular to a longitudinal axis 202 extending through bit 101 and holder body 103. Recess 201 is defined axially by a radially inward facing surface indicated generally by reference 204 that extends axially between innermost end surface 217 and rearward end surface 200. Recess 201 includes a mouth region indicated generally by reference 218 that is flared radially outward relative to surface 204 towards innermost end surface 217. Mouth 218 is defined generally by a radially inward facing convex surface 206 that extends radially outward from axis 202. Convex surface 206 is terminated at an axially rearward region by a step indicated generally by reference 219 that has a substantially cylindrical entrance surface 203 aligned parallel with axis 202 and projecting rearwardly from the axially rearwardmost part of convex surface 206. Annular surface 203 extends axially from bit end surface 200 and extends a relatively short axial distance relative to an axial depth of groove 205.

An annular groove 205 is indented in bit 101 and projects radially outward from recess 201 at an axial mid-region between end surface 200 and innermost end surface 217. Groove 205 has a generally cylindrical configuration and is shaped and dimension to accommodate an annular retainer 213 configured to releasably secure bit 101 to adaptor 102.

Adaptor 102 includes an elongate shaft 214 that extends axially from an adaptor head (alternatively termed a projection) 207. Projection 207 has a substantially planar end surface 208 to sit against recess end surface 217 or to be positioned in near touching contact with minimal clearance. The general shape and configuration of projection 207 is substantially identical to the shape and configuration of recess 201 such that projection 207 is positionable within recess 201 to mount bit 101 at adaptor 102. Holder body 103 includes a through bore 221 extending between forward end 107 and in particular a substantially planar end surface 222 and rearward end 108. Shaft 214 is positioned coaxially within bore 221 such that a rearward shaft end 216 extends axially beyond holder body end 108. An end region 215 of shaft 214 has threads to receive a threaded nut for releasable locking of adaptor 102 at holder body 103.

Projection 207 includes a skirt 401 that is flared radially outward relative to an end most region (corresponding to end surface 208). Skirt 401 is defined by a radially outward facing concave surface 209 that terminates at a radially outermost position with an annular substantially cylindrical surface 210. An annular underside surface 211 projects radially between shaft 214 and a radially rearwardmost part of annular surface 210. Underside surface 211 is configured for positioning in near touching contact with holder body end surface 222 (preferably with a clearance of less than 1 mm) to be positioned substantially coplanar with the bit end surface 200 (also mounted in near touching contact with holder body end surface 222).

Annular retainer 213 is mounted radially about projection 207 and is at least partially accommodated within a radially indented region 212 provided at a radially outward facing projection surface axially between concave surface 209 and end surface 208. As illustrated in FIG. 2, bit convex surface 206 and projection concave surface 209 are configured to be complementary and positioned in close touching contact to provide efficient load transmission. Similarly, close or near mating contact is provided between the radially outward facing projection surface 210 and the annular entrance surface 203 of recess 201. That is, recess 201 at the region of mouth 218 is completely occupied by the skirt 401 to provide the close fitting contact between the projection skirt 401 and the radially inner facing surfaces 206, 203 of recess 201. This is advantageous to provide optimised load transfer via a maximised surface area contact between bit 201 and projection 207. Moreover, this fully mated configuration at step region 219 prevents dust, fluids and other contaminants from passing axially towards the innermost end surface 217 of recess 201. The dirt, dust and fluid ingress is prevented from axial advancement beyond step 219 due to the angled orientation of the respective concave and convex surfaces 209, 206 with respect to the annular cylindrical surfaces 210, 203 that are aligned parallel to axis 202 that collectively define step 219.

Annular retainer 213 may have a simple one-piece ring like component. Alternatively, retainer 213 may have bearings and be a multi-component unit to facilitate the free-rotation of bit 101 about projection 207. As illustrated in FIG. 2, an axial length of retainer 213 is approximately equal to the axial length of groove 205 to optimise the surface contact area between a radially inward facing retainer surface 220 and the radially outward facing retainer surface at indented region 212. Such a configuration effectively balances the assembly (101, 102) at the holder body 103 and allows rotation of bit 101 about axis 202 to avoid gyroscopic procession due to axial misalignment of bit 101 relative to projection 207 and/or holder body 103.

Figure 3:
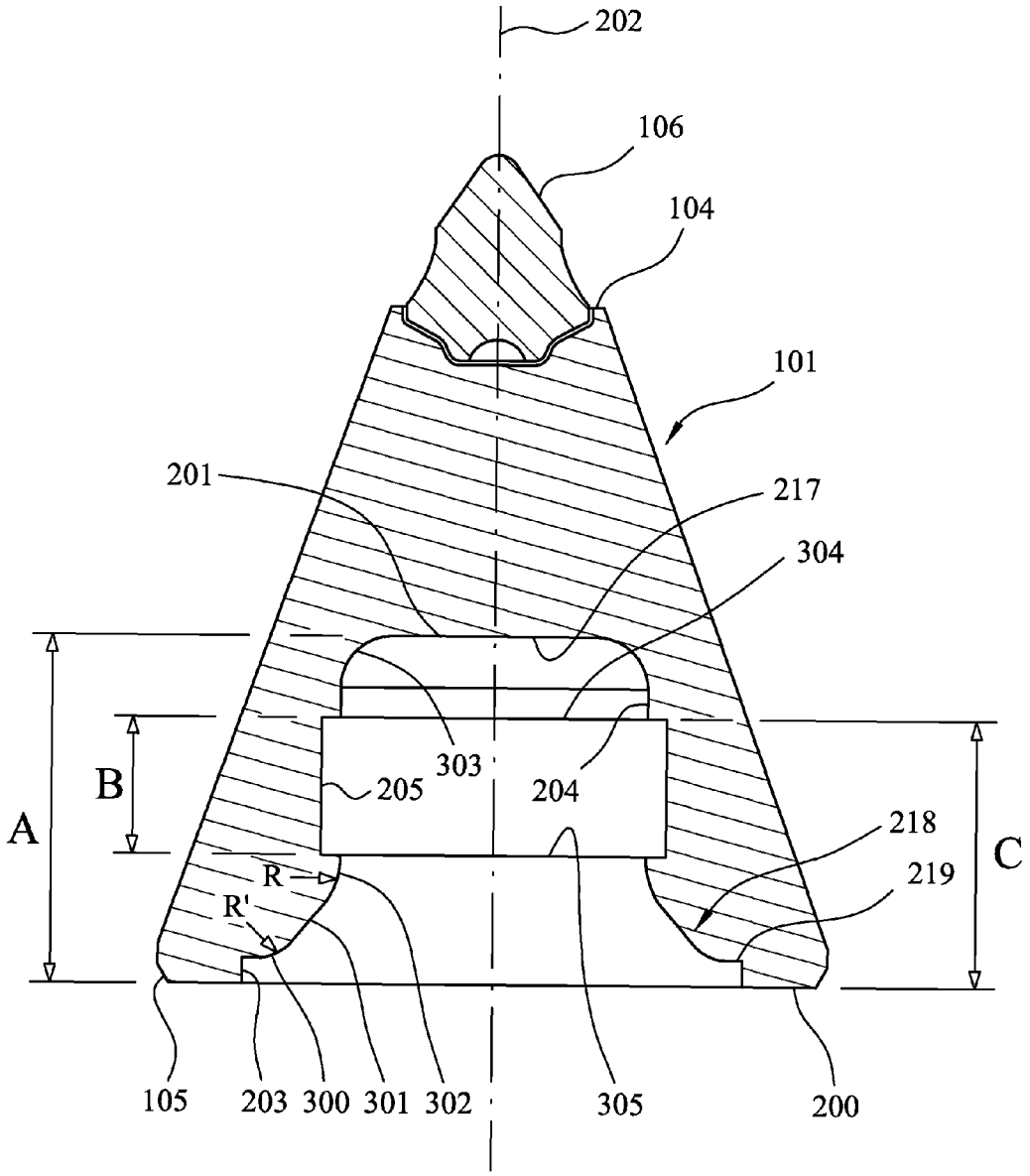
FIG. 3 is a cross sectional side view of the cutting bit of FIG. 2.

Referring to FIG. 3, recess 201 includes an axial depth A corresponding to the axial distance between innermost end surface 217 and rearwardmost end surface 200. Retaining groove 205 has an axial length B defined between an axially forwardmost end edge 304 and axially rearwardmost end edge 305. According to the specific implementation, length B is approximately 30% to 45% the axial depth A. An axial depth C corresponding to the axial distance between axially forwardmost end edge 304 and rearwardmost end surface 200. According to the specific implementation, length B is approximately 40% to 55% the axial depth C. Such a configuration provides for the stabilised retention of bit 101 at projection 207 as the surface area contact between retainer 213, bit 101 and projection 207 is enhanced relative to existing bit assemblies.

The transition between the axially extending inward facing recess surface 204 and end surface 217 is provided by an annular concave surface 303. As indicated, the radially inward facing recess surface 206 at the region of mouth 218 is generally convex relative to axis 202. This generally convex surface 206 comprises three surface regions 300, 301, 302 (distributed axially between end surface 200 and groove 205). An axially rearwardmost surface 300 has a convex shape profile having a radius of curvature R'. This second mouth surface 300 extends from step 219 and an axially end most part of entrance surface 203. Third mouth surface 301 is substantially conical and tapers radially inward from the second surface 300 to a radially innermost first mouth surface 302 positioned axially behind groove 205. First surface 302 is also convex and comprises a radius of curvature R. Accordingly, the radii of curvature R is greater than or equal to one quarter of the axial distance C. Additionally, the radii of curvature R' (and optionally R according to further embodiments) may be greater than or equal to one fifth of the axial distance C. Such a configuration is advantageous to provide optimised low transmission from bit 101 to projection 207. Moreover, effective load transfer is achieved as the radially inward facing surface 206 at mouth 218 is convex and/or tapers radially outward (surfaces 300, 301, 302) axially between the rearwardmost groove end 305 and entrance surface 203 aligned substantially parallel with axis 202. This radially flared contact with the skirt 401 of projection 207 allows the load transmission in a plurality of directions relative to axis 202 which in turn provides a stabilising affect for the rotation of bit 101 at adaptor 102.

Figure 4:
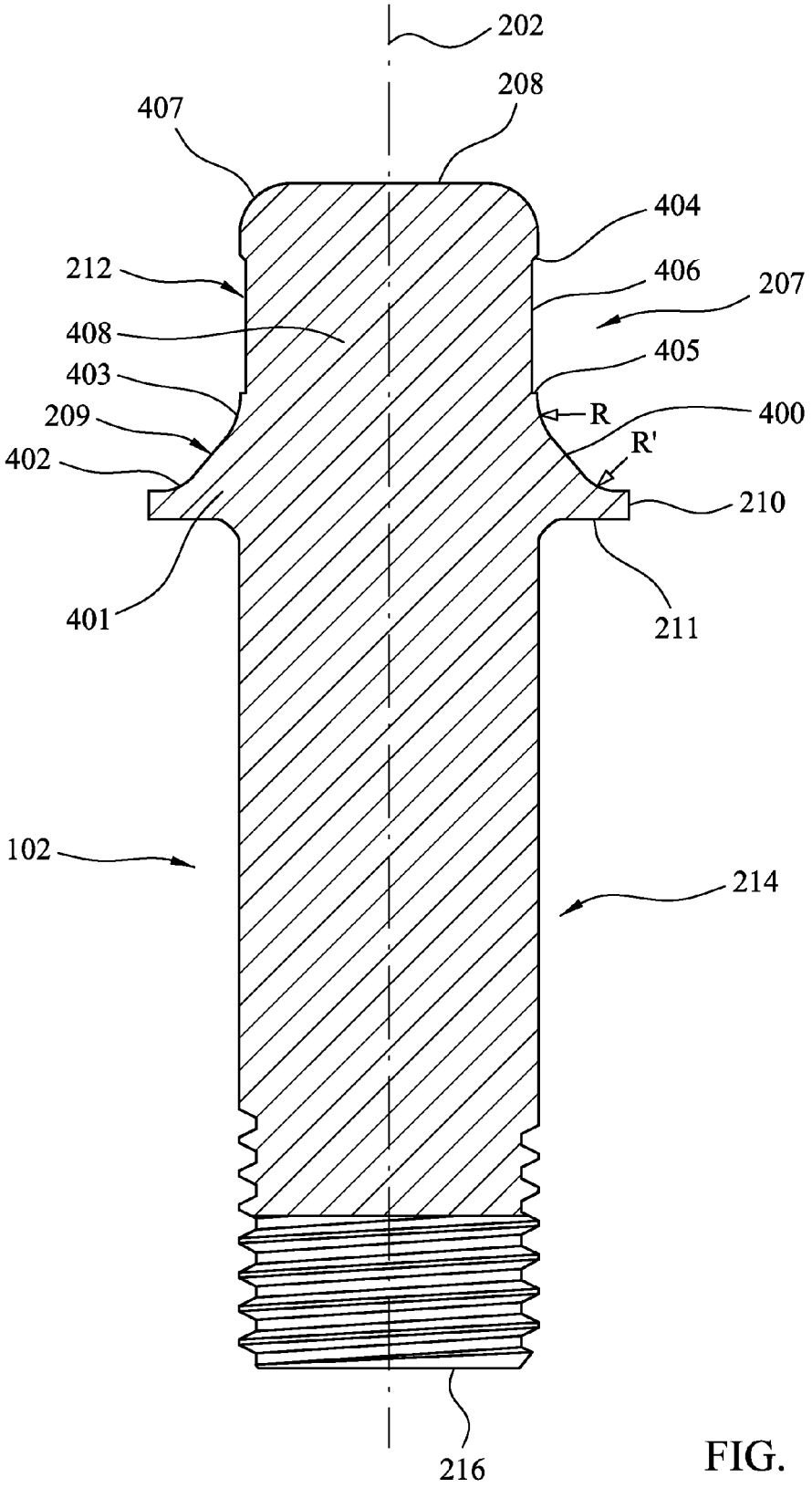
FIG. 4 is a cross sectional side view of the shank-like adaptor of FIG. 2.

Referring to FIG. 4, the concave surface 209 at the skirt 401 of projection 207 may be divided axially into three corresponding surface regions 402, 400 and 403. Axially rearwardmost region 402 includes radius of curvature R' whilst an axially forwardmost region 403 has corresponding radius of curvature R. Axially intermediate surface region 400 has a conical tapered shape profile such that the projection skirt 401 decreases from the annular cylindrical surface 210 to the recessed region 212 (configured to seat retainer 213). Indented region 212 is defined by an axially rearwardmost edge 405, an axially forwardmost edge 404 and a substantially cylindrical outward facing surface 406 extending axially between edges 404, 405 and aligned parallel to axis 202. Accordingly, projection 207 includes an end most head region 408 configured to be received at the axially innermost region of cavity 201 from which extends the radially flared skirt 401 comprising concave surfaces 402, 403, conical surface 400, cylindrical skirt surface 210 and rearward facing annular end surface 211 aligned perpendicular to axis 202.

The end most region of head 408 comprises an annular convex surface 407 that extends axially between the forwardmost edge 404 and the substantially planar end surface 208. As illustrated in FIG. 2, the shape and configuration of surfaces 407, 208 are complementary to the corresponding surfaces 303, 217 of the bit recess 201 to provide close fitting contact between projection 207 within recess 201.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

The invention claimed is:

1. A cutting bit for mounting at a cutting machine comprising:

an axially tapered bit body having a forward end providing a cutting tip and a rearward end for mounting at a bit holder;

a recess extending axially within the body from the rearward end, the recess having an innermost region and a mouth region located substantially at the rearward end, the recess being defined axially by a radially inward facing annular surface;

a groove projecting radially outward into the body from the recess at an axial position between the innermost region and the mouth region, wherein the radially inward facing surface includes a section that is generally convex and tapered radially outward at an axial position between the groove and rearward end to abut a corresponding concave or tapered surface of a projection to secure the cutting bit at a holder body; and an annular step positioned within the recess at the mouth region axially between the section and the rearward end, the step being defined by a convex mouth surface that is an axially rearward part of the section and that terminates axially at the step and an annular entrance surface extending axially forward from the rearward end and aligned transverse or perpendicular to the mouth surface, wherein a radius of the radially inward facing surface at the section is greater than or equal to a fifth of a distance from the rearward end of the body to an axially forwardmost region of the groove.

2. The bit as claimed in claim 1, wherein the entrance surface is aligned substantially parallel with the longitudinal axis of the bit.

3. The bit as claimed in claim 1, wherein the innermost region of the recess is defined by a substantially planar surface bordered at a perimeter by an annular concave surface region.

4. The bit as claimed in claim 3, wherein a width or diameter of the substantially planar surface is 50% to 100% of an axial depth of the recess between the rearward end of the body and an axially forwardmost region of the groove.

5. The bit as claimed in claim 1, wherein the radially inward facing surface at the section includes a first convex region extending axially rearward of the groove, the convex mouth surface extending axially forward from the entrance surface.

6. The bit as claimed in claim 5, wherein a surface profile of the recess at a region axially between the first convex region and mouth surface is tapered radially outward from the first convex region to the mouth surface.

7. The bit as claimed in claim 5, wherein a surface profile of the recess at a region axially between the first convex region and the mouth surface is convex to provide a singularly convex surface extending axially between the groove and the entrance surface.

8. A cutting bit for mounting at a cutting machine comprising:

an axially tapered bit body having a forward end providing a cutting tip and a rearward end for mounting at a bit holder;

a recess extending axially within the body from the rearward end, the recess having an innermost region and a mouth region located substantially at the rearward end, the recess being defined axially by a radially inward facing annular surface;

a groove projecting radially outward into the body from the recess at an axial position between the innermost region and the mouth region, wherein the radially inward facing surface includes a section that is generally convex and tapered radially outward at an axial position between the groove and rearward end to abut a corresponding concave or tapered surface of a projection to secure the cutting bit at a holder body; and an annular step positioned within the recess at the mouth region axially between the section and the rearward end, the step being defined by a convex mouth surface that is an axially rearward part of the section and that terminates axially at the step and an annular entrance surface extending axially forward from the rearward end and aligned transverse or perpendicular to the mouth surface, wherein an axial length of the groove is in the range of 30 to 60% of an axial distance of the recess between the rearward end of the body and an axially forwardmost region of the groove.

9. The bit as claimed in claim 8, wherein the axial length of the groove is in the range of 40 to 55%.

10. The bit as claimed in claim 8, wherein the entrance surface is aligned substantially parallel with the longitudinal axis of the bit.

11. The bit as claimed in claim 8, wherein the innermost region of the recess is defined by a substantially planar surface bordered at a perimeter by an annular concave surface region.

12. The bit as claimed in claim 11, wherein a width or diameter of the substantially planar surface is 50% to 100% of an axial depth of the recess between the rearward end of the body and an axially forwardmost region of the groove.

13. The bit as claimed in claim 8, wherein the radially inward facing surface at the section includes a first convex region extending axially rearward of the groove, the convex mouth surface extending axially forward from the entrance surface.

14. The bit as claimed in claim 13, wherein a surface profile of the recess at a region axially between the first convex region and mouth surface is tapered radially outward from the first convex region to the mouth surface.

15. The bit as claimed in claim 13, wherein a surface profile of the recess at a region axially between the first convex region and the mouth surface is convex to provide a singularly convex surface extending axially between the groove and the entrance surface.

16. A cutting bit assembly for mounting at a cutting machine comprising:

a holder body mounted or mountable at a region of a cutting machine;

a projection extending from the body and configured to be received within the recess of the cutting bit, the cutting bit including an axially tapered bit body having a forward end providing a cutting tip and a rearward end for mounting at a bit holder; a recess extending axially within the body from the rearward end , the recess having an innermost region and a mouth region located substantially at the rearward end , the recess being defined axially by a radially inward facing annular surface; a groove projecting radially outward into the body from the recess at an axial position between the innermost region and the mouth region, wherein the radially inward facing surface includes a section that is generally convex and tapered radially outward at an axial position between the groove and rearward end to abut a corresponding concave or tapered surface of a projection to secure the cutting bit at a holder body; and an annular step positioned within the recess at the mouth region axially between the section and the rearward end, the step being defined by a convex mouth surface that is an axially rearward part of the section and that terminates axially at the step and an annular entrance surface extending axially forward from the rearward end and aligned transverse or perpendicular to the mouth surface, wherein the projection includes a head and a skirt, wherein the head is positionable at the innermost region of the recess and a radially outermost surface region of the skirt is configured to be accommodated within the annular step at or in near-touching contact with the entrance surface.

17. The assembly as claimed in claim 16, wherein the projection includes a concave and radially outward tapered surface profile axially between the head and the skirt to mate cooperatively with the surface at section of the recess.

18. The assembly as claimed in claim 16, further comprising a locking collar radially positioned around a region of the projection and configured to be accommodated within the groove to provide an axial lock of the bit at the projection.

19. The assembly as claimed in claim 16, wherein the holder body includes a through bore and the projection includes a rearwardly extending shaft, the shaft being mountable within the bore to secure the projection at the holder body.

* * * * *